US010624168B2

(12) United States Patent
Bandel

(10) Patent No.: US 10,624,168 B2
(45) Date of Patent: Apr. 14, 2020

(54) PROGRAMMABLE LIGHT EMITTING DIODE LUMINAIRE

(71) Applicant: Hubbell Incorporated, Shelton, CT (US)

(72) Inventor: Michael Bandel, North Aurora, IL (US)

(73) Assignee: Hubbell Incorporated, Shelton, CT (US)

( * ) Notice: Subject to any disclaimer, the term of this patent is extended or adjusted under 35 U.S.C. 154(b) by 6 days.

(21) Appl. No.: 15/946,949

(22) Filed: Apr. 6, 2018

(65) Prior Publication Data

US 2018/0295689 A1 Oct. 11, 2018

Related U.S. Application Data

(60) Provisional application No. 62/483,009, filed on Apr. 7, 2017.

(51) Int. Cl.
*H05B 33/08* (2020.01)
*F21V 23/00* (2015.01)
*F21Y 115/10* (2016.01)

(52) U.S. Cl.
CPC ..... *H05B 33/0842* (2013.01); *F21V 23/004* (2013.01); *F21Y 2115/10* (2016.08)

(58) Field of Classification Search
CPC ... F21V 23/004; F21Y 2115/10; H05B 33/08; H05B 33/0842; H05B 33/0845; H05B 37/02
USPC ..... 315/151–158, 185 R, 209 R, 291, 294, 315/307, 308, 312
See application file for complete search history.

(56) References Cited

U.S. PATENT DOCUMENTS

| | | | | |
|---|---|---|---|---|
| 8,729,808 | B2 * | 5/2014 | Knibbe | H04B 10/1149 315/151 |
| 9,974,147 | B1 | 5/2018 | Davis et al. | |
| 2007/0262934 | A1 * | 11/2007 | Fujikawa | G06K 15/1209 345/82 |
| 2009/0237011 | A1 * | 9/2009 | Shah | H05B 33/0803 315/312 |
| 2011/0248644 | A1 | 10/2011 | Welten et al. | |
| 2012/0119661 | A1 * | 5/2012 | Muller | F21K 9/00 315/158 |
| 2012/0280637 | A1 * | 11/2012 | Tikkanen | H05B 33/0803 315/294 |
| 2012/0294000 | A1 | 11/2012 | Thomas et al. | |
| 2013/0264943 | A1 | 10/2013 | Bora | |
| 2013/0320874 | A1 | 12/2013 | Ingram | |
| 2015/0195883 | A1 * | 7/2015 | Harris | H05B 33/0845 315/155 |

(Continued)

OTHER PUBLICATIONS

PCT/US2018/026416 International Search Report and Written Opinion dated Jul. 9, 2018 (15 pages).

*Primary Examiner* — Jimmy T Vu
(74) *Attorney, Agent, or Firm* — Michael Best & Friedrich, LLP

(57) ABSTRACT

LED luminaires including an LED engine as the vehicle for programming the LED driver. An example luminaire includes an LED engine including a non-transitory memory having driver parameters and an LED driver coupled to the LED engine. The LED driver is configured to receive the driver parameters from the non-transitory memory and to provide a power based on the driver parameters. The luminaire further includes a plurality of LEDs to be driven by the power from the LED driver.

11 Claims, 5 Drawing Sheets

(56) References Cited

U.S. PATENT DOCUMENTS

2015/0296598 A1* 10/2015 Haid ..... H05B 37/0272
315/291
2015/0305122 A1 10/2015 Saes et al.

* cited by examiner

PROGRAMMABLE LIGHT EMITTING DIODE LUMINAIRE

RELATED APPLICATION

The present application claims the benefit of U.S. Provisional Patent Application No. 62/483,009, filed Apr. 7, 2017, the entire contents of which is hereby incorporated by reference.

FIELD

Various exemplary embodiments relate to light luminaires, and more specifically, light emitting diode luminaires (or fixtures) having a light emitting diode driver and a light emitting diode engine.

BACKGROUND

Programmable drivers, such as drivers used in light emitting diode (LED) luminaires, are programmed directly through many communications methods. The drivers are programmable, either one at a time, or in a group. Programming drivers one at a time can be a labor intensive process. When programming in a group, one problem is that it is difficult to discern if an error has been made in the programming until the programmed drivers are inserted into the fixture. Unless each programmed driver is put through a physical measurement of the setting, signals, or both, to confirm the programming, one may not know whether the programming was successful. Another problem is knowing what parameters may have been programmed into a driver intended for field replacement. For example, even if drivers are labeled after they have been programmed, the labels may age, fade, fall off, or otherwise become unreadable. Also, mix-ups can occur in drivers that have been programmed to one set of parameters, but which accidentally get placed in a group for drivers programmed with another, different set of parameters. One possible solution is to train humans to avoid these errors by looking at the instances of human interaction with the products and intervening with quality control measures. However, training humans and checking for errors increases time and cost of driver production and programming.

Driver manufacturers also struggle with how to add wireless communication means to the drivers without creating other problems associated with the LED driver placement in LED lighting fixtures. LED drivers are sometimes surrounded with grounded metal such that communications wirelessly via antenna is made difficult due to reduced communications range.

Accordingly, embodiments presented herein provide, among other things, LED luminaires where the LED engine is the vehicle for programming the LED driver.

SUMMARY

According to one example embodiment, a luminaire includes an LED engine including a non-transitory memory having driver parameters and an LED driver coupled to the LED engine. The LED driver is configured to receive the driver parameters from the non-transitory memory and to provide a power based on the driver parameters. The luminaire further includes a plurality of LEDs to be driven by the power from the LED driver.

In another example embodiment, the LED engine includes a program capacitor instead of the non-transitory memory.

BRIEF DESCRIPTION OF THE DRAWINGS

The aspects and features of various exemplary embodiments will be more apparent from the description of those exemplary embodiments taken with reference to the accompanying drawings, in which.

Figure 1:
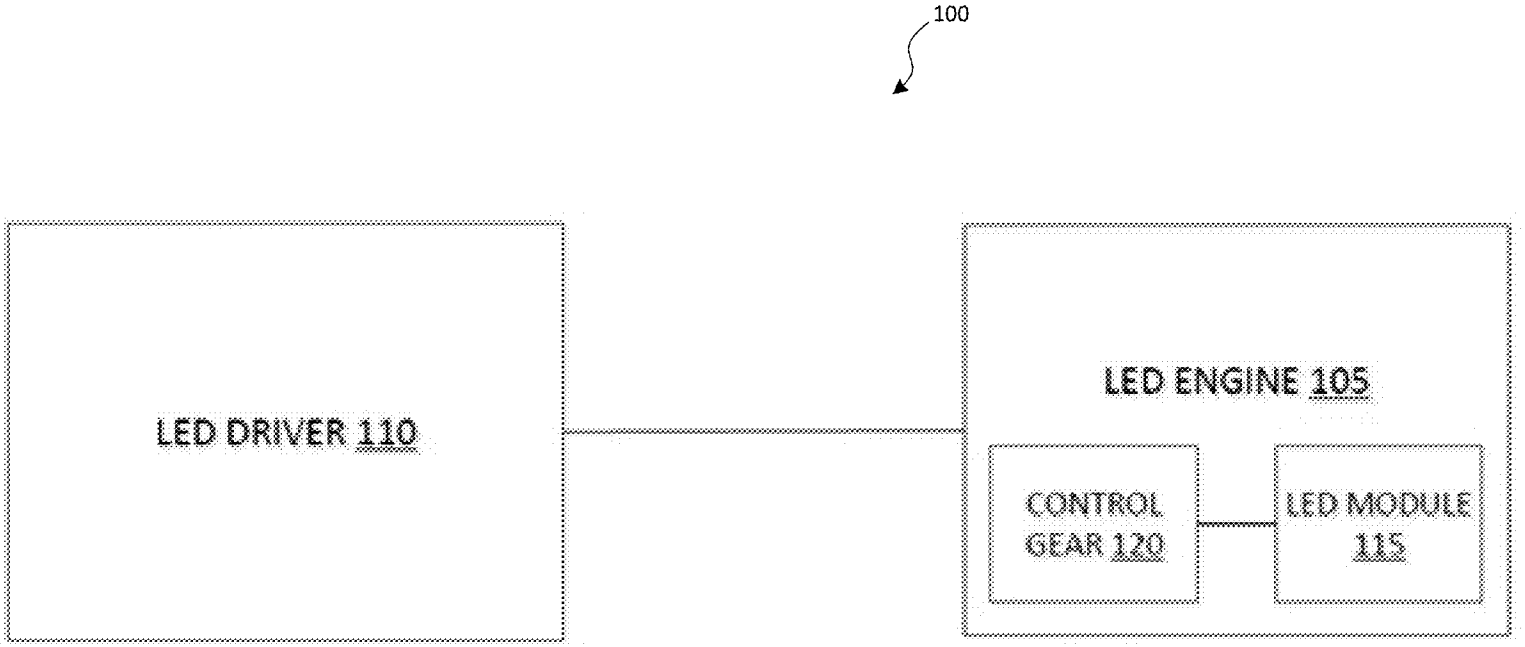
FIG. 1 is a block diagram of a luminaire, according to some embodiments

The apparatus and method components have been represented where appropriate by conventional symbols in the drawings, showing only those specific details that are pertinent to understanding the embodiments of the invention so as not to obscure the disclosure with details that will be readily apparent to those of ordinary skill in the art having the benefit of the description herein.

DETAILED DESCRIPTION OF EXEMPLARY EMBODIMENTS

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting, and coupling. Further, "connected" and "coupled" are not restricted to physical or mechanical connections or couplings, and can include electrical connections or couplings, whether direct or indirect. Also, electronic communications and notifications may be performed using any known means including wired connections, wireless connections, etc.

It should also be noted that a plurality of hardware and software based devices, as well as a plurality of different structural components may be used to implement the invention. In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic-based aspects of the invention may be implemented in software (e.g., stored on non-transitory computer-readable medium) executable by one or more processors. As such, it should be noted that a plurality of hardware and software based devices, as well as a plurality of different structural components may be utilized to implement the invention. For example, "control units" and "controllers" described in the specification can include one or more processors, one or more memory modules including non-transitory computer-readable medium, one or more input/output interfaces, and various connections (e.g., a system bus) connecting the components.

For ease of description, some or all of the exemplary systems presented herein are illustrated with a single exemplar of each of its component parts. Some examples may not describe or illustrate all components of the systems. Other exemplary embodiments may include more or fewer of each of the illustrated components, may combine some components, or may include additional or alternative components.

FIG. 1 illustrates an example luminaire 100. In the embodiment illustrated, the luminaire 100 includes, among other things, an LED engine 105 and an LED driver 110. The luminaire includes other conventional elements not shown in FIG. 1, including a housing that supports the LED engine 105 and the LED driver 110, a mechanical attachment for coupling the luminaire 100 to a building structure, an electrical connection coupling the LED driver to a power source, a heat sink for electrical components of the luminaire, and a reflector.

The LED engine 105 includes a light source. The light source includes LEDs distributed on a printed circuit board forming an LED module 115 (also known as an array or a package). The LEDs are arranged to achieve some greater lumens and greater illumination pattern capability. The LED engine 105 further includes related control gear 120 for the LED module 115.

In some embodiments, the LED engine 105 is an integrated assembly comprised of the LED module 115 and the control gear 120. In some embodiments, the LED module 115 and the control gear 120 are different assemblies connected by one or more suitable conductors.

The LED engine 105 includes additional electronic circuitry (not shown) to perform other functions related to the intended luminaire design or some general system design application. The LED engine 105 is usually intended to be easily interfaced to some form of heat-sinking for the purposes of thermal management within a luminaire. Since the starting point of the LED engine design is some total lumen requirement followed by other luminaire design and application considerations, this tends to determine the type (for example, single chip versus multi-chip array) and number of LEDs required on a printed circuit board. When multiple discrete LEDs are distributed on a printed circuit board, they are to be arranged in series/parallel combinations. Parallel strings of LEDs share current and series connected LEDs build load voltage. For example if a manufacturer uses nine total LEDs with a forward voltage of 3V to run at 0.7 A each, the LEDs can be connected in several ways. If all are in series, driving the LEDs would require an LED driver with a constant current 0.7 A output that has a compliance voltage in the range of 3V per each of the nine LEDs, or about 27V. However, if a manufacturer cannot obtain such a driver, it could configure the LEDs in three parallel strings each consisting of three LEDs in series. In such configuration, the manufacturer needs an LED driver that provides 2.1 A (0.7 A per each of three strings) and a forward voltage of 9V (3V per LED). Note that the power required in each case is 18.9 watts (27V×0.7 A=9V×2.1 A). There are other considerations for the series-parallel combinations that are sometimes accounted for in LED engine and ultimately luminaire design. For example, nine LEDs in series means that if one fails open circuit, then all LEDs turn off and the entire LED engine goes dark. However, if there are parallel strings, a few LEDs (a string) may go dark when one LED fails, but the current will redistribute to the others and still produce some light.

The LED driver 110 is a power supply that performs power conversion from one form to another (for example, from AC to DC) consistent with connection to and operation of an appropriately matched LED engine 105. A typical LED driver 110 input operates off of AC branch limited mains power. The typical LED driver 110 output is a DC constant current type output of appropriate voltage and current levels for operation of the matched LED engine 105 in order to generate some specified light output (in lumens) from said LED engine 105. In some embodiments, the LED driver 110 has a constant DC voltage output (for example, as in the case of the classic power supply). However, since LEDs produce lumens proportional to their current input, the use of constant current drivers has become the most widely used. There are also a class of LED drivers that convert DC constant voltage input to a DC constant current output, bucking and/or boosting the voltage and current parameters as required for the LED engine 105 application. The LED driver 110 may have other aspects including dimming, programming, and multiple outputs.

In one construction, the LED driver 110 includes a printed circuit board (PCB) that is populated with a plurality of electrical and electronic components (not shown) to provide power, operational control, and protection for the LED driver 110. In some constructions, the LED driver 110 includes, for example, an electronic processing unit (for example, a microcontroller) for controlling the voltage or current provided by the LED driver 110 to the LED engine 105. The LED driver 110 includes additional passive and active electronic components (for example, resistors, capacitors, inductors, integrated circuits, and amplifiers). These components are arranged and connected to provide a plurality of electrical functions to the LED driver 110 including, among other things, filtering, signal conditioning, voltage regulation, current regulation, or combinations of the foregoing. For descriptive purposes, the PCB and the electrical components populated on the PCB are collectively referred to as the LED driver 110.

Matching an LED driver 110 to an LED light engine 105 can be a complex process. LED driver manufacturers initially started with wattage classes of drivers offering models within those classes of different constant current outputs. This involved having many different SKUs available for customers, whose requirements varied as much as one could vary the LEDs connected in the LED engine. The next iteration of driver design was the so-called programmable driver. This allowed for a driver to be programmed to one of a group of constant currents, reducing both manufacturer and customer-required SKUs. However, this created different problems. For example, the customer could assume responsibility for programming; however, programming drivers may not match their typical technical and manufacturing capabilities. This could increase customer costs. To address this, the manufacturer can offer programming. However, they would have to handle the product in order to program it, which again increases costs. Some manufacturers addressed this problem by designing ways to program boxes or whole pallets of drivers. This capability could be passed on to customers interested in the having the capability for themselves.

Because the LED engines already contained electronic components, one could put a programming resistor on the LED engine, add the connections to the programming inputs of the driver, and let the LED engine program the driver. However, more sophisticated programmability connection methods (wired or wireless) evolved to where simple resistance programming (setting of the output constant current only) was not sufficient.

Accordingly, in embodiments presented herein, the LED engine 105, instead of the LED driver 110, includes the interface for programming the LED driver 110. In various constructions herein, the LED engine 105 is the vehicle for programming the LED driver 110. In one luminaire 200, illustrated in FIG. 2, the LED engine 105 uses a programmable memory chip 205 (for example, a serial electrically erasable programmable read-only memory ("EEPROM")) on the LED engine 105 that can be programmed anytime during or after manufacture of the LED engine 105 such that when the LED driver 110 is enabled it's fed the parameters desired at the time of manufacture or anytime thereafter.

Figure 2:
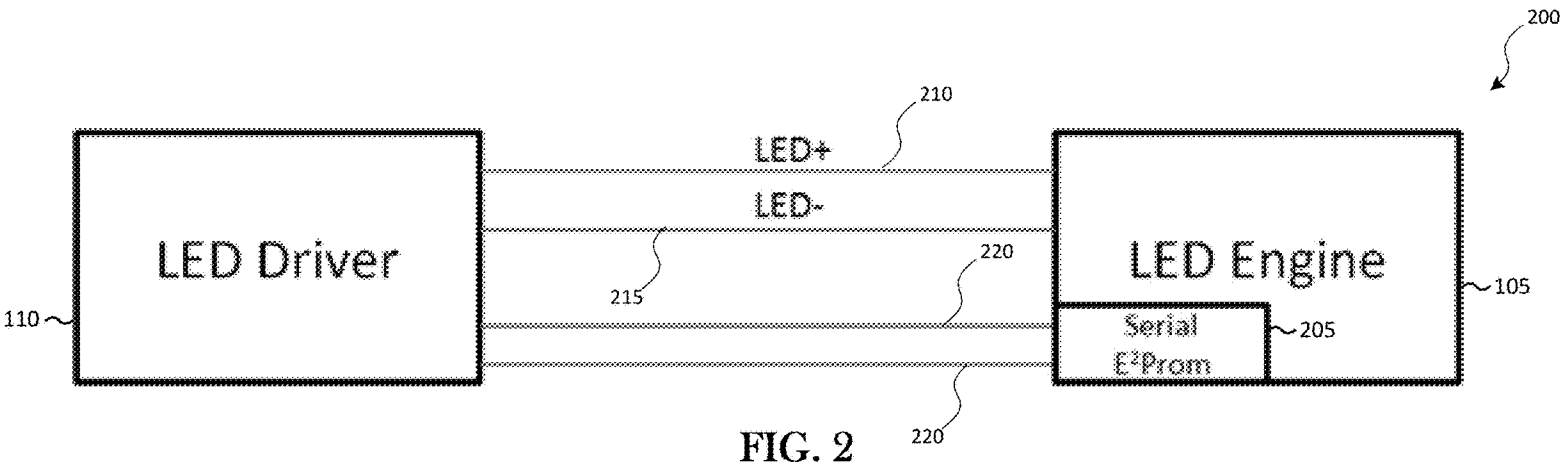
FIG. 2 is a block diagram of the luminaire of FIG. 1 including a programmable memory chip for programming the LED driver, according to some embodiments.

As illustrated in FIG. 2, the luminaire 200 uses the memory chip 205 as one implementation for programming an LED driver 110. The memory chip 205 is an example of a non-transitory memory capable of being used with the LED engine 105. FIG. 2 also shows a first power rail 210 (LED+), a second power rail 215 (LED−), and two communication connectors 220.

The memory chip 205 is placed on the LED engine 105 along with the LED module 115. Power to operate the memory chip 205 is derived by extracting energy from the LED load circuit. When the luminaire 200 is energized, the memory chip 205 makes available predefined values that represent, for example, the constant current setting, dimming control parameters, and lumen maintenance settings.

The memory chip 205 can be programmed by direct electrical connection, (for example, by connection to a computer via a cable or connection to a computer via an assembly line in-circuit test system) or by a wireless connection (for example, Bluetooth, NFC, RFID, and Zigbee). This embodiment solves the field programming issue for replacement drivers. It simplifies the LED driver design in that the LED driver 110 requires a communication link only to the LED Engine 105. The implementation provides more control in maintaining separation of Class 1 versus Class 2 circuits. When a fixture is ordered by a customer, significant customization of parameters may be required. This requires that the luminaire 200 be built to some specific characteristics, but will also require the LED driver 110 to be programmed as well. Embodiments of the invention put the burden of customization upon the LED engine 105. In the case of interactive wireless transmission and reception, the LED engine 105 can seamlessly communicate to the LED driver 110 as required. Since the LED engine 105 usually faces the environment through a lens or diffuser, a wireless antenna can be etched into the printed circuit board; whereas, attaching an antenna to the LED driver 110 may be problematic. Also, there would be an additional benefit in that one can envision a method of communicating the programming parameters of the LED driver 110 by superimposing it on the first power rail 210 and the second power rail 215 between the LED driver 110 and the LED engine 105. This would reduce the number of wire connections in the luminaire.

Another benefit relates to the field replacement problem previously mentioned. Without good records and sometimes with degradation due to age, there may be no way to know what parameters an LED driver needs to be programmed with. In a luminaire where the LED engine 105 programs the LED driver 110, the person replacing the driver need not be concerned with the parameters. In fact, the LED driver 110 simply resides in stock and requires no special attention. The attention goes to the LED engine 105 since customers already specify custom characteristics, (for example, color temperature) to begin with. By placing an interface at the LED engine 105 board, one opens an aperture sufficient for transmission and reception for wireless command and control.

Figure 3:
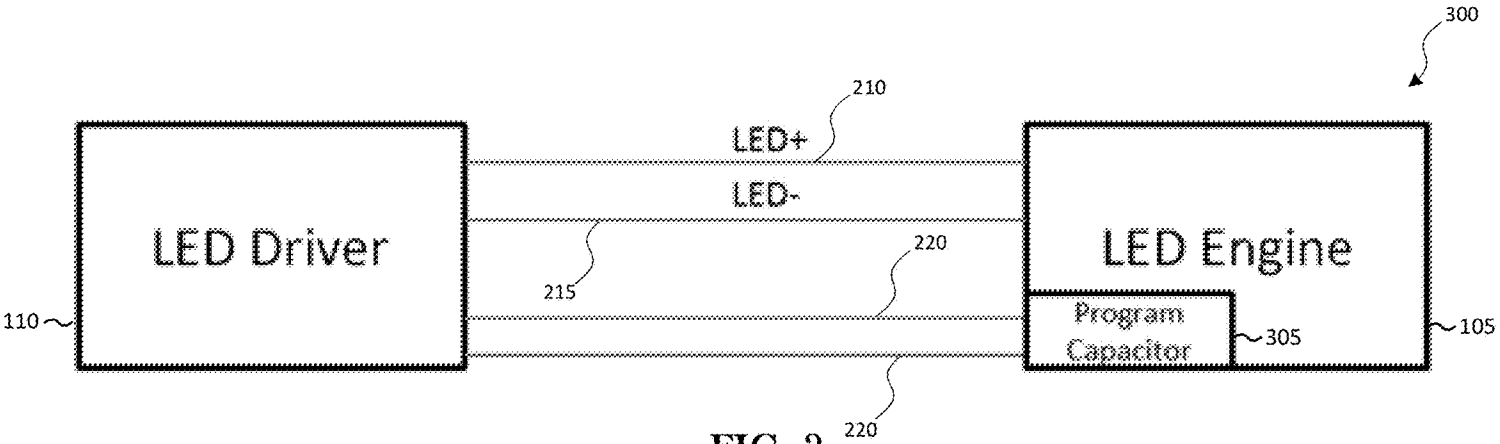
FIG. 3 is a block diagram of a luminaire including a program capacitor, according to some embodiments.

FIG. 3 illustrates another embodiment where the LED engine 105 is the vehicle for programming the LED driver 110. As illustrated in FIG. 3, the luminaire 300 includes an LED 105 that includes a program capacitor 305 as an alternative to a programming resistor.

Figure 4:
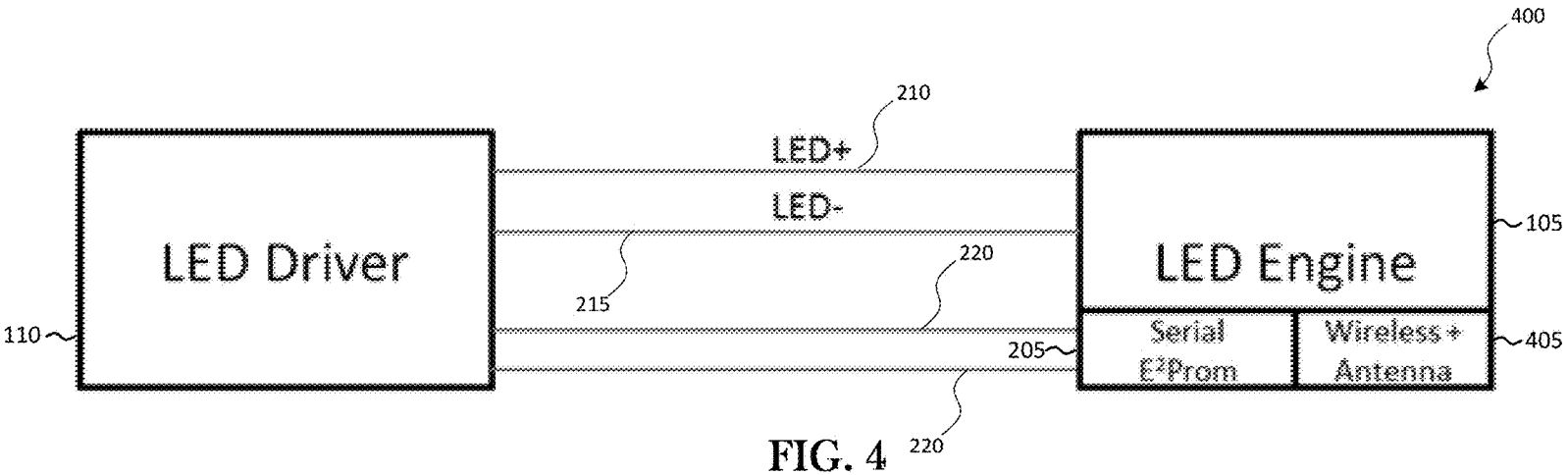
FIG. 4 is a block diagram of a luminaire including a programmable memory chip connected to an antenna and wireless circuitry, according to some embodiments.

FIG. 4 illustrates another embodiment where the LED engine 105 is the vehicle for programming the LED driver 110. As illustrated in FIG. 4, the luminaire 400 includes the programmable memory chip 205 connected to a wireless interface 405, which includes an antenna and wireless circuitry. The programmable memory chip 205 can be programmed with driver parameters via the wireless interface 405.

Figure 5:
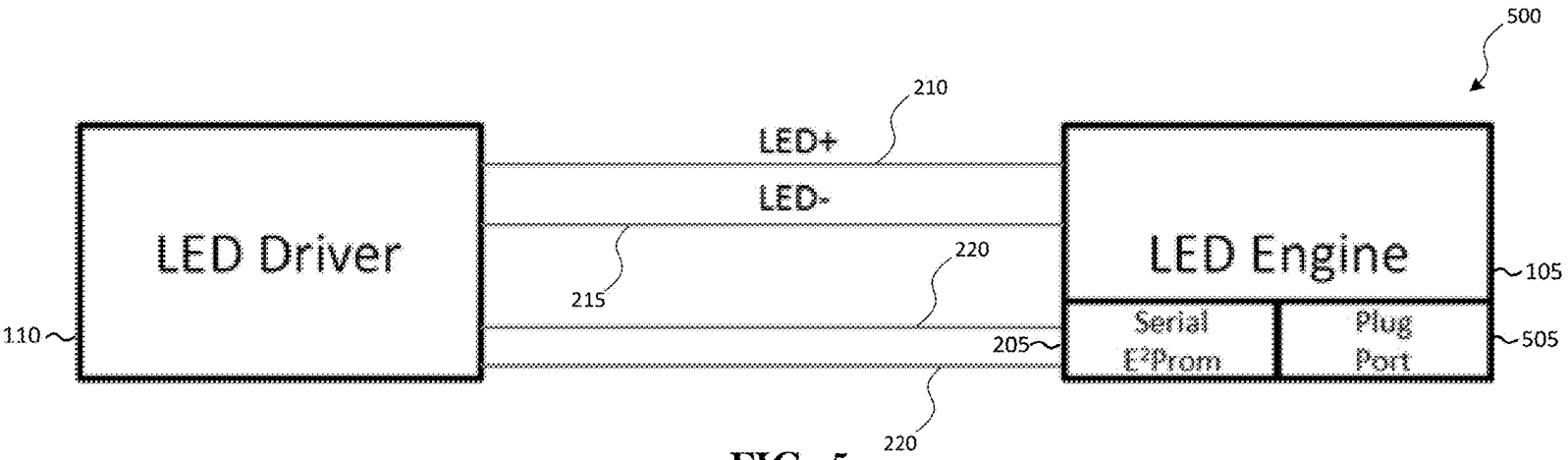
FIG. 5 is a block diagram of a luminaire including a programmable memory chip connected to a computer programming receptacle, according to some embodiments.

FIG. 5 illustrates another embodiment where the LED engine 105 is the vehicle for programming the LED driver 110. As illustrated in FIG. 5, the luminaire 500 includes the programmable memory chip 205 connected to a computer programming receptacle 505. The programmable memory chip 205 can be programmed with driver parameters via the computer programming receptacle 505.

Figure 6:
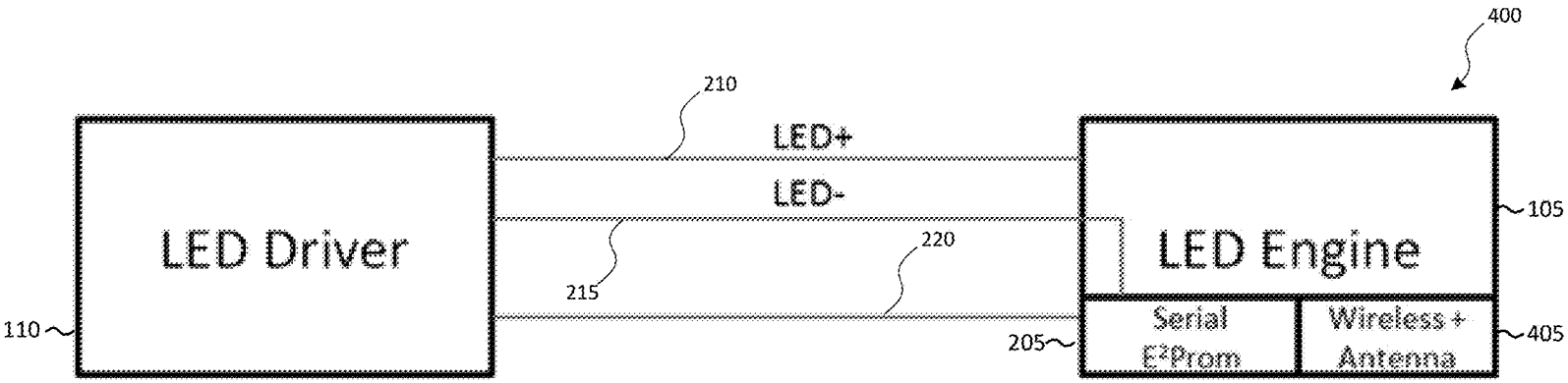
FIG. 6 is a block diagram of a luminaire including a programmable memory chip connected to an antenna and wireless circuitry sharing a common ground, according to some embodiments.

FIG. 6 illustrates another embodiment of the luminaire 400. As illustrated in FIG. 6, the luminaire 400 includes the programmable memory chip 205 connected to the wireless interface 405. In the embodiment illustrated in FIG. 6, the programmable memory chip 205 and the wireless interface 405 share a common ground (for example, the second power rail 215).

Figure 7:
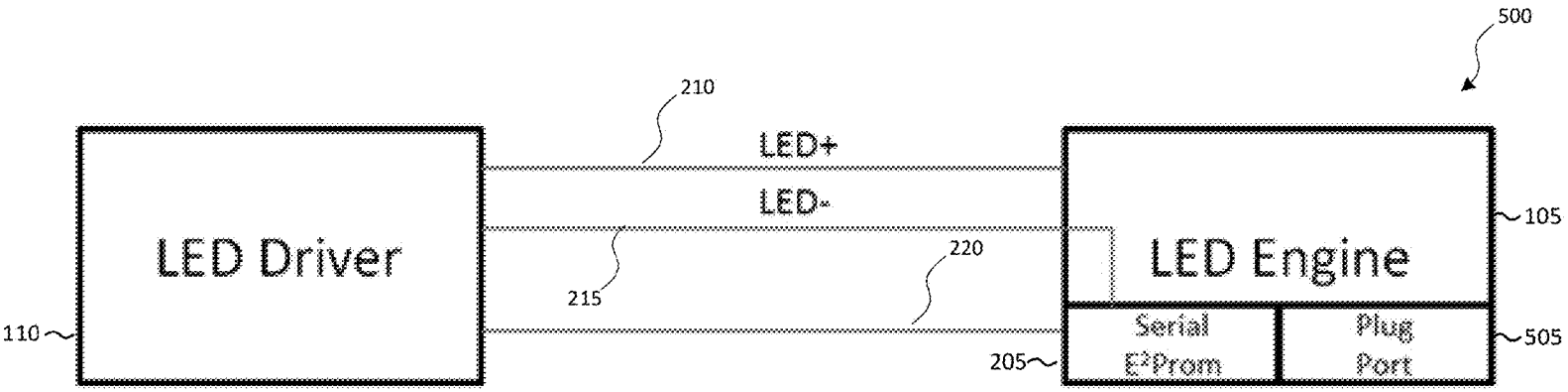
FIG. 7 is a block diagram of a luminaire including a programmable memory chip connected to a computer port programming receptacle sharing a common ground, according to some embodiments.

FIG. 7 illustrates another embodiment of the luminaire 500. As illustrated in FIG. 7, the luminaire 500 includes the programmable memory chip 205 connected to the computer programming receptacle 505. In the embodiment illustrated in FIG. 7, the programmable memory chip 205 and the computer programming receptacle 505 share a common ground (for example, the second power rail 215).

Figure 8:
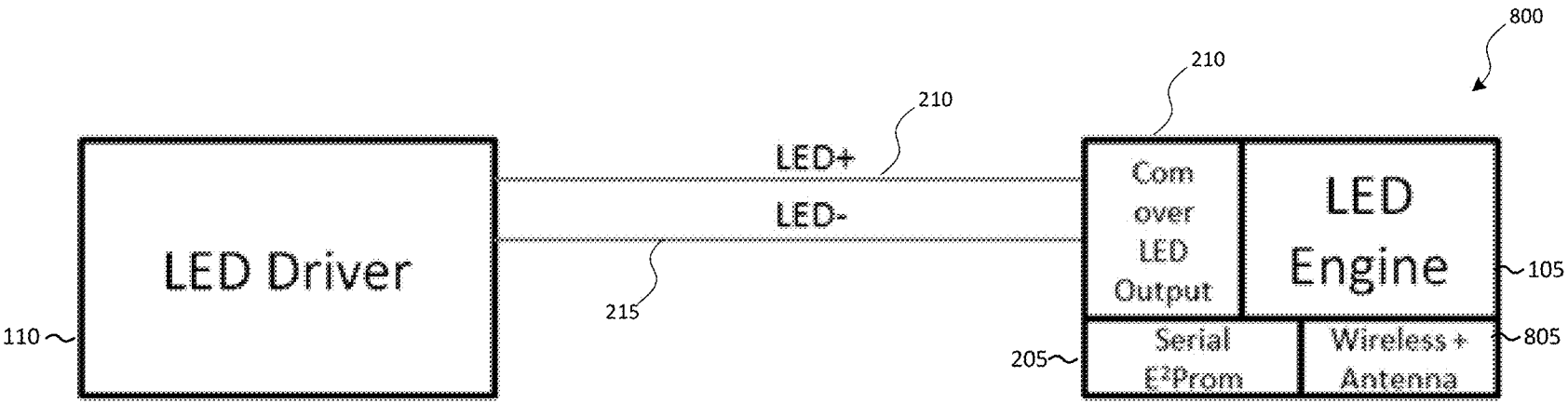
FIG. 8 is a block diagram of a luminaire including a programmable memory chip connected to an antenna and wireless circuitry, in communication over power rails, according to some embodiments.

FIG. 8 illustrates another embodiment where the LED engine 105 is the vehicle for programming the LED driver 110. As illustrated in FIG. 8, the luminaire 800 includes the programmable memory chip 205 connected to a wireless interface 805, which includes an antenna and wireless circuitry. As illustrated in FIG. 8, the luminaire 800 includes the programmable memory chip 205 connected to the wireless interface 805. In the embodiment illustrated, the programmable memory chip 205 communicates with the LED driver 110 using communications over the first and second power rails 210, 215 to program the LED driver 110.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

Thus, the embodiments presented herein provide, among other things, LED luminaires where the LED engine is the vehicle for programming the LED driver. Various features and advantages of the invention are set forth in the following claims.

What is claimed:

1. A luminaire comprising:

an LED engine including a non-transitory memory having driver parameters;

an LED driver coupled to the LED engine via a first power rail and a second power rail, the LED driver configured to receive the driver parameters from the non-transitory memory over the first power rail and the second power rail and to provide a power based on the driver parameters; and a plurality of LEDs configured to be driven by the power from the LED driver wherein the LED engine further includes wireless communication circuitry coupled to the non-transitory memory.

2. The luminaire of claim 1, wherein the LED engine includes the plurality of LEDs.

3. The luminaire of claim 1, wherein the non-transitory memory receives the driver parameters via the wireless communication circuitry.

4. The luminaire of claim 1, and further comprising a first communication connector and a second communication connector coupling the LED driver to the non-transitory memory.

5. The luminaire of claim 1, and further comprising a communication rail coupling the LED driver to the non-transitory memory, and the non-transitory memory is further coupled to the second power rail.

6. The luminaire of claim 1, wherein the LED engine further includes circuitry for communicating the driver parameters over the first power rail and the second power rail.

7. The luminaire of claim 1, wherein the LED engine further includes a communication port and wherein the non-transitory memory receives the driver parameters via the wireless communication circuitry.

8. The luminaire of claim 1, wherein the power includes a constant current based on the driver parameters.

9. The luminaire of claim 1, wherein the power includes a constant voltage based on the driver parameters.

10. The luminaire of claim 1, wherein the driver parameters include a dimming control parameter.

11. The luminaire of claim 1, wherein the driver parameters include a lumen maintenance setting.

* * * * *